US009190734B2

(12) United States Patent
Niver et al.

(10) Patent No.: US 9,190,734 B2
(45) Date of Patent: Nov. 17, 2015

(54) BROADBAND CIRCULARLY POLARIZED BENT-DIPOLE BASED ANTENNAS

(75) Inventors: Edip Niver, Mountainside, NJ (US); Oksana Manzhura, Basking Ridge, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 70 days.

(21) Appl. No.: 13/814,918

(22) PCT Filed: Aug. 8, 2012

(86) PCT No.: PCT/US2012/049883

§ 371 (c)(1),
(2), (4) Date: Feb. 7, 2013

(87) PCT Pub. No.: WO2013/022906

PCT Pub. Date: Feb. 14, 2013

(65) Prior Publication Data

US 2014/0232606 A1 Aug. 21, 2014

Related U.S. Application Data

(60) Provisional application No. 61/521,457, filed on Aug. 9, 2011.

(51) Int. Cl.
*H01Q 9/28* (2006.01)
*H01Q 21/26* (2006.01)

(52) U.S. Cl.
CPC ..... *H01Q 9/285* (2013.01); *H01Q 21/26* (2013.01)

(58) Field of Classification Search
CPC . H01Q 21/061; H01Q 19/108; H01Q 5/0072; H01Q 1/38; H01Q 9/42; H01Q 9/28; H01Q 19/10; H01Q 9/26; H01Q 9/16; H01Q 21/26; H01Q 9/285
USPC ..... 343/797
See application file for complete search history.

(56) References Cited

U.S. PATENT DOCUMENTS

| | | | | |
|---|---|---|---|---|
| 5,111,213 | A | 5/1992 | Jahoda et al. | |
| 5,418,544 | A * | 5/1995 | Elliot | 343/797 |
| 5,784,032 | A | 7/1998 | Johnston et al. | |
| 6,618,016 | B1 * | 9/2003 | Hannan et al. | 343/705 |
| 6,667,721 | B1 | 12/2003 | Simonds | |
| 7,019,708 | B2 | 3/2006 | Regala | |

(Continued)

OTHER PUBLICATIONS

Liu, H. et al., "Broadband Circularly Polarized Moxon Based Antennas for UHF SATCOM, RFID and GPS," PIERS Proceedings, Moscow, Russia, Aug. 19-23, 2012, pp. 234-238.

(Continued)

*Primary Examiner* — Dameon E Levi
*Assistant Examiner* — Jennifer F Hu
(74) *Attorney, Agent, or Firm* — Turk IP Law, LLC

(57) ABSTRACT

Technologies are presented for providing circularly polarized antenna topologies based on multiple bent-dipole elements over a ground plane configuration. In some examples, Moxon based cross radiating elements may be fed through a hybrid 90° quadrature coupler. The radiating element may be widened and tapered relative to a standard bent-dipole configuration forming bow tie structures with approximately 90° bends to achieve broadband operation. The tapered branches may be split into two sub-branches and the bend angle increased to further increase bandwidth and gain of the antenna.

20 Claims, 9 Drawing Sheets

(56) References Cited

U.S. PATENT DOCUMENTS

| | | | | |
|---|---|---|---|---|
| 7,567,215 | B1 | 7/2009 | All et al. | |
| 2001/0048395 | A1 | 12/2001 | Apostolos | |
| 2001/0050640 | A1* | 12/2001 | Apostolos | 343/700 MS |
| 2007/0080878 | A1 | 4/2007 | McLean | |
| 2007/0109131 | A1 | 5/2007 | Kai et al. | |
| 2007/0176838 | A1* | 8/2007 | Zink et al. | 343/797 |
| 2008/0309568 | A1* | 12/2008 | Deng et al. | 343/757 |
| 2009/0073049 | A1* | 3/2009 | Apostolos | 343/700 MS |
| 2009/0204372 | A1* | 8/2009 | Johnston et al. | 702/191 |
| 2009/0303136 | A1 | 12/2009 | Kuramoto et al. | |
| 2010/0109840 | A1* | 5/2010 | Schilling | 340/10.1 |
| 2010/0117914 | A1* | 5/2010 | Feller et al. | 343/757 |
| 2010/0171675 | A1 | 7/2010 | Borja et al. | |
| 2010/0245183 | A1* | 9/2010 | Hyvonen et al. | 343/702 |
| 2012/0188140 | A1* | 7/2012 | Bin Jamlus et al. | 343/795 |

OTHER PUBLICATIONS

Chu, L.J., "Physical Limitations on Omni-Directional Antennas," Journal of Applied Physics, vol. 19, Issue 12, 1948, pp. 1163-1175, May 1948.

Wheeler, H.A., "Fundamental Limitations of Small Antennas," Proceedings of the IRE, vol. 35, Issue 12, Dec. 1947, pp. 1479-1484.

Hanson, R.C., "Fundamental Limitations in Antennas," Proceedings of the IEEE, vol. 69, Issue 2, Feb. 1981, pp. 170-182.

Lien et al., "Couple-fed Circular Polarization Bow Tie Microstrip Antenna," PIERS Online vol. 3, No. 2, (2007) pp. 220-224.

Liu et al., "Broadband CP Moxon Based Antennae for RFID and GPS," PIERS 2012 in Moscow, Russian Federation, Aug. 20-25, 2012.

Niver et al., "UHF SATCOM Broadband CP Antennae: Moxon Type Bent Dipoles Over a Ground Plane," 30th PIERS in Suzhou, China, Sep. 12-16, 2011. Retrieved from PIERS Online vol. 7, No. 8, (2011) pp. 726-730.

Tekin et al., "Broadband Circularly Polarized Antennas for UHF SATCOM," XXX General Assembly and Scientific Symposium of the International Union of Radio Science (URSI), Istanbul, Turkey, Aug. 13-20, 2011.

International Search Report and Written Opinion for PCT/US 12/49883, filed Aug. 8, 2012, mailed on Oct. 22, 2012.

International Preliminary Report on Patentability for PCT/US12/049883, issued Feb. 11, 2014.

Wheeler, "Small Antennas", Antenna Engineering Handbook, Chapter 6, 3rd Edition, 20 pages, Dec. 1992.

G. Marrocco, "The Art of UHF RFID Antenna Design: Impedance-Matching and Size-Reduction Techniques," IEEE Antennas and Propagation Magazine, vol. 50, No. 1, 66-79, Feb. 2008.

M. Nagatoshi, S. Tanaka, S. Horiuchi and H. Morishita, "Downsized Bow-Tie Antenna with Folded Elements," IEICE trans electron, vol. E93-C, No. 7, Jul. 2010.

* cited by examiner

BROADBAND CIRCULARLY POLARIZED BENT-DIPOLE BASED ANTENNAS

CROSS-REFERENCE TO RELATED APPLICATIONS

This Application is the U.S. National Stage filing under 35 U.S.C §371 of PCT Application Ser. No. PCT/US12/49883 filed on Aug. 8, 2012, which claims benefit under 35 U.S.C §119 (e) to US Provisional Application Ser. No. 61/521,457 filed on Aug. 9, 2011. The PCT Application and the US Provisional Application are herein incorporated by reference in their entireties.

BACKGROUND

Unless otherwise indicated herein, the materials described in this section are not prior art to the claims in this application and are not admitted to be prior art by inclusion in this section.

Wide band needs of modern communication applications on airborne and ground platforms at high frequency (HF), very high frequency (VHF), and ultra-high frequency (UHF) bands result in desired antenna specifications such as high forward gain, low cross-polarization, low back lobe radiation, compact size, and low cost. Some widely used SATCOM antennas in the UHF band include, for example, the eggbeater antenna including two cross circular loop antennas coupled to a hybrid quadrature coupler.

In Radio Frequency Identification (RFID) mobile applications, an RFID reader antenna needs to have high performance including a broadband operation, circular polarization, and a large angular coverage from horizon to zenith. For systems at RFID frequencies (e.g., 900 MHz range), wavelength may be on the order of one third to one quarter of a meter and conventional antennas may be physically too large for commercial use. In GPS applications, antennas need to have precise narrow band performance at specific frequency bands (e.g., L1 and L2 bands).

SUMMARY

The present disclosure generally describes technologies for providing broadband circularly polarized bent-dipole based antennas.

According to some example embodiments, broadband, circularly polarized, bent-dipole based antennas are provided. The antennas may include one or more of two or more bent-dipole based radiating elements, where the radiating elements have a tapered cross-sectional shape, a common input for the two or more radiating elements, and/or a ground plane at an approximately equal distance from the radiating elements.

According to other example embodiments, methods for providing broadband, circularly polarized wireless communication through a bent-dipole based antenna are provided. The methods may include one or more of providing an antenna that includes two or more bent-dipole based radiating elements, where the radiating elements have a tapered cross-sectional shape terminated with a horizontal bend, and a ground plane at an approximately equal distance from the radiating elements. The methods may also include providing a signal to a common input for the two or more radiating elements.

According to further example embodiments, broadband, circularly polarized, bent-dipole based antennas are provided. The antennas may include one or more of two bent-dipole based radiating elements, each element having a tapered cross-sectional shape widening from a feed point outward and a split forming two sub-branches terminated with a horizontal bend, where the radiating elements are in a substantially perpendicular configuration forming a bow tie structure, a common input for the two or more radiating elements, and a ground plane at an approximately equal distance from tips of the radiating elements.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
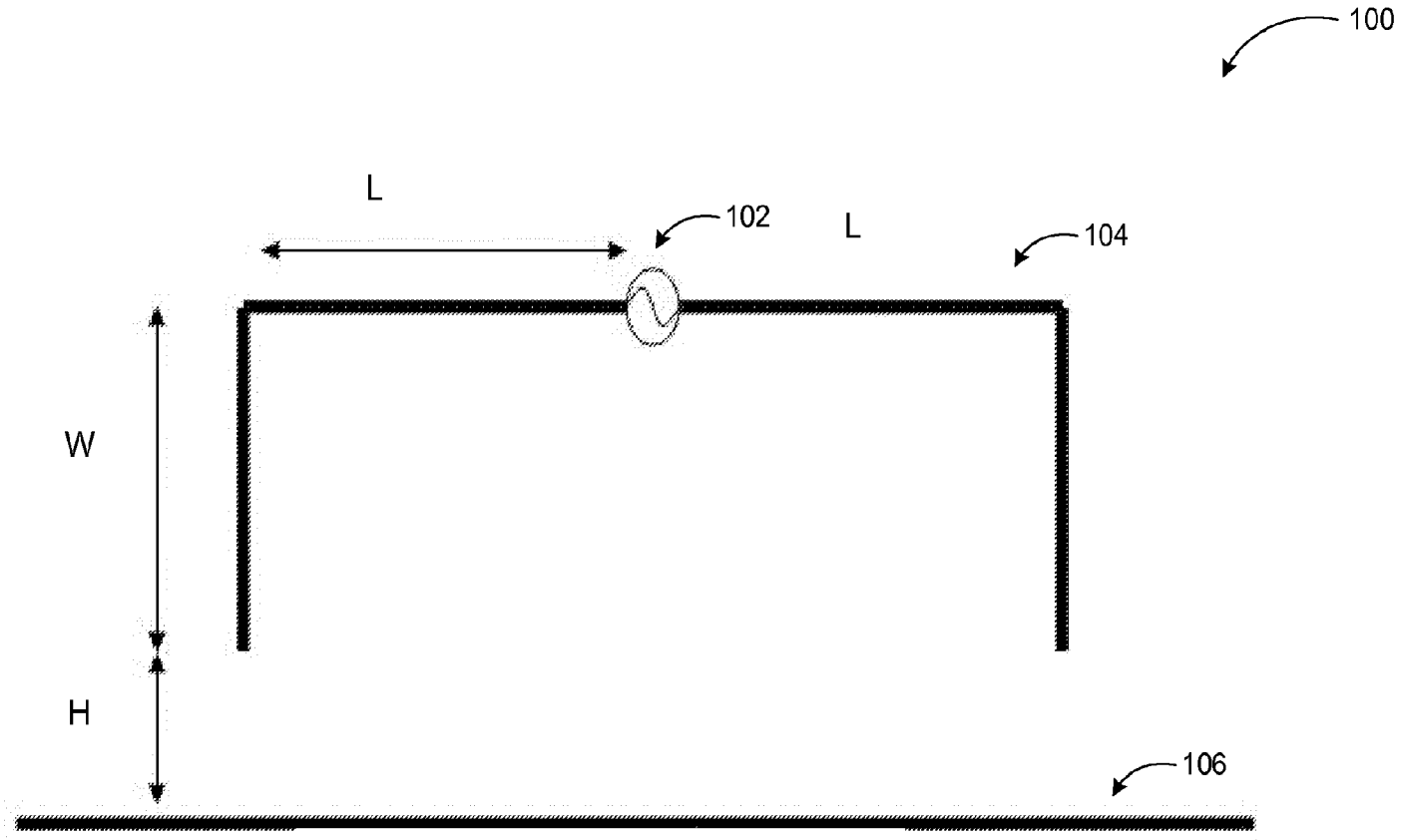
FIG. 1 illustrates an example Moxon-like bent-dipole antenna over a ground plane.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to apparatus, systems, and/or devices related to broadband circularly polarized obliquely bent-dipole based antennas.

Briefly stated, technologies are presented for providing circularly polarized antenna topologies based on multiple obliquely bent-dipole elements over a ground plane configuration. In some examples, Moxon based cross radiating elements may be fed through a hybrid 90° quadrature coupler.

The radiating element may be widened and tapered relative to a standard bent-dipole configuration forming bow tie structures with approximately 90° bends to achieve broadband operation. The oblique tapered branches may be split into two sub-branches terminated with a horizontal bend and the bend angle increased to further increase bandwidth and gain of the antenna.

FIG. 1 illustrates an example Moxon-like bent-dipole antenna over a ground plane, arranged in accordance with at least some embodiments described herein.

A dipole antenna is one of the basic radiating components in antenna engineering and can be produced from a simple wire, with a center-fed driven element. Two conductive elements, oriented parallel and collinear with each other may form a dipole antenna. An alternating voltage applied to the antenna at the center, between the two conductive elements is converted into radio waves and transmitted from the antenna. Dipole antennas are the basic elements of a multitude of more complex antennas such as multi-element Yagi-Uda antennas, egg beater antennas, and Moxon antennas commonly used in amateur radio communications.

A Moxon antenna includes a bent-dipole 104 over the ground reflector 106, which produces enhanced front-to-back ratio of radiated power, a match over relatively wide frequency band, and lowered elevation height. A Moxon antenna may be viewed as a two-element Yagi-Uda antenna. A Moxon antenna may be formed using one or more bent-dipole elements, for example, two perpendicular bent-dipoles. As shown in a diagram 100, a bent-dipole 104 with a voltage feed 102 may have two arms, each arm having a length of L+W (lengths of the first and second portions of each arm bent in a substantially perpendicular fashion). Thus, each arm may be bent toward the ground reflector 106 from L distance away from the center of the dipole. The end points of the bent-dipole 104 may be H away from the ground reflector 106 as shown in the diagram 100. The bent-dipole 104 may be fed from the center of the antenna with a differential input.

Circular polarization is desired in many communication systems such as RFID, Global Positioning Service (GPS), and other satellite communications since it reduces signal loss due to receiving/transmitting antenna orientation. In a bent-dipole based system, right hand circular polarization (RHCP) may be obtained simply by placing two bent-dipole antennas substantially perpendicular to each other, one in x-z plane, the other in y-z plane and feeding them through a hybrid quadrature coupler.

Figure 2A:
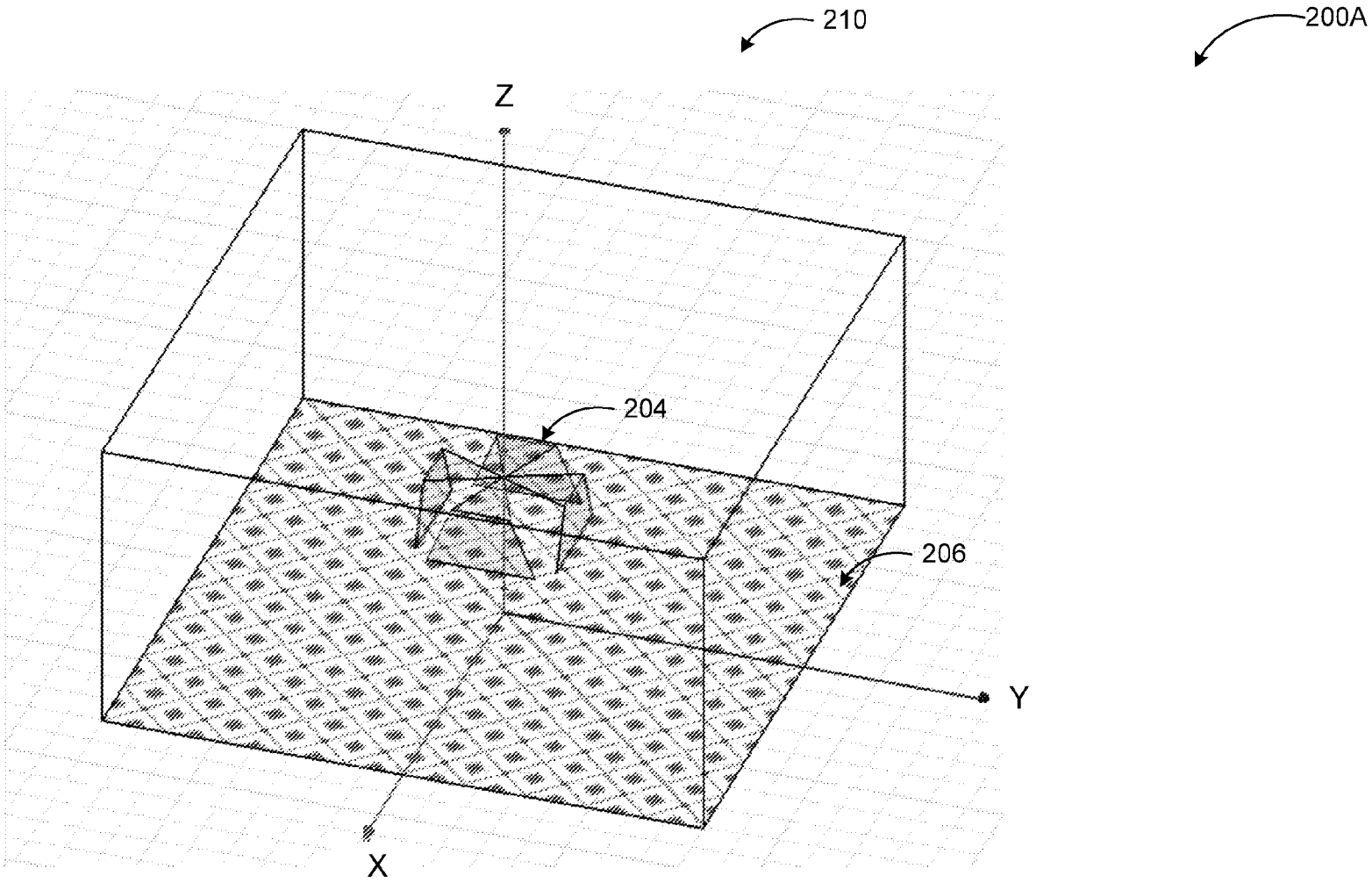
FIGS. 2A and 2B illustrate two example Moxon based bow tie antenna structures in three dimensional views.
Figure 2B:
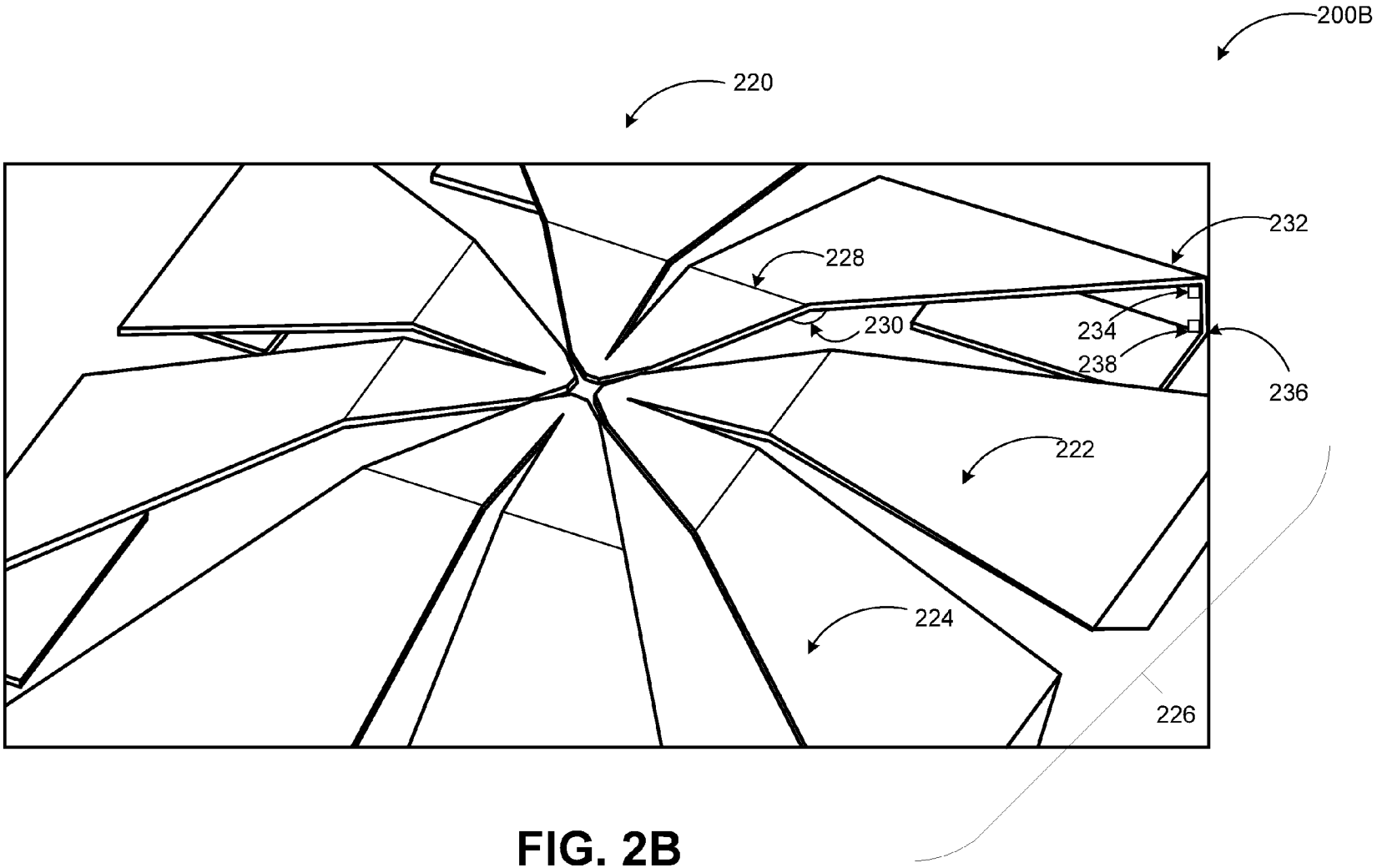

FIGS. 2A and 2B illustrate two example Moxon based bow tie antenna structures in three dimensional views, arranged in accordance with at least some embodiments described herein.

For broadband operations, the radiating elements of an antenna according to embodiments may be tapered resulting in a "bow tie" antenna. Bow tie antennas have a wider impedance bandwidth than a dipole antenna with thin elements due to the tapered widening of the elements. By selecting suitable lengths, heights, and tapering parameters for the radiating elements of the bowtie antenna, as well as number of elements, the broad bandwidth may be optimized around selected frequencies such as VHF, UHF, or GPS frequency ranges. For example, a broadband, circularly polarized SATCOM antenna with relatively high gain optimized for the 200-400 MHz range may have following dimensions: length of horizontal arms (L): approx. 60 mm, length of vertical arms (W): approx. 82 mm, distance from the ground plane (H): approx. 120 mm, width of the arms at the center of the antenna (D): approx. 4 mm, and a taper angle ($\alpha$): approx. 22.5 deg. Such an antenna may be produced using any suitable conductive material such as copper.

Diagram 200A in FIG. 2A illustrates an example antenna configuration 210 according to some example embodiments. The example antenna configuration 210 may include a two cross-element, bent-dipole, bow tie antenna 204 over a ground plane 206. Diagram 200B in FIG. 2B illustrates another example antenna configuration 220 including a similar bow tie antenna, where each arm 226, or radiating element, of the antenna is split into two pieces (e.g., 222, 224). The split (wedge) of each of the antenna arms may provide additional control over the selection of the bandwidth and a center frequency of the antenna. Thus, by selecting an angle of the wedge, the bandwidth of the antenna may be increased (or decreased) and the center frequency shifted to a desired resonance frequency. Each arm 226 of the antenna may have a first bend 228 associated with a first bend angle 230, a second bend 232 associated with a second bend angle 234, and a third bend 236 associated with a third bend angle 238, as illustrated in the diagram 200B. In some embodiments, the second bend angle 234 may be a sharper angle than the first bend angle 230. For example, the second bend angle 234 may be a 90° angle, where the first bend angle 230 may be an obtuse angle greater than 90° and less than 180°, as illustrated in the diagram 200B. In other embodiments, the third bend angle 238 may also be a sharper angle than the first bend angle 230. Furthermore, the third bend angle 238 may be an angle equal to the second bend angle 234. For example, the third bend angle 238 may be a 90° angle, which may be equal to the 90° angle of the second bend angle 234, and accordingly sharper than the obtuse first bend angle 230, as illustrated in the diagram 200B. Consequently, the third bend 236 may cause a portion of each arm 226 of the antenna to substantially fold under the antenna in a substantially parallel configuration to the ground plane.

Figure 3:
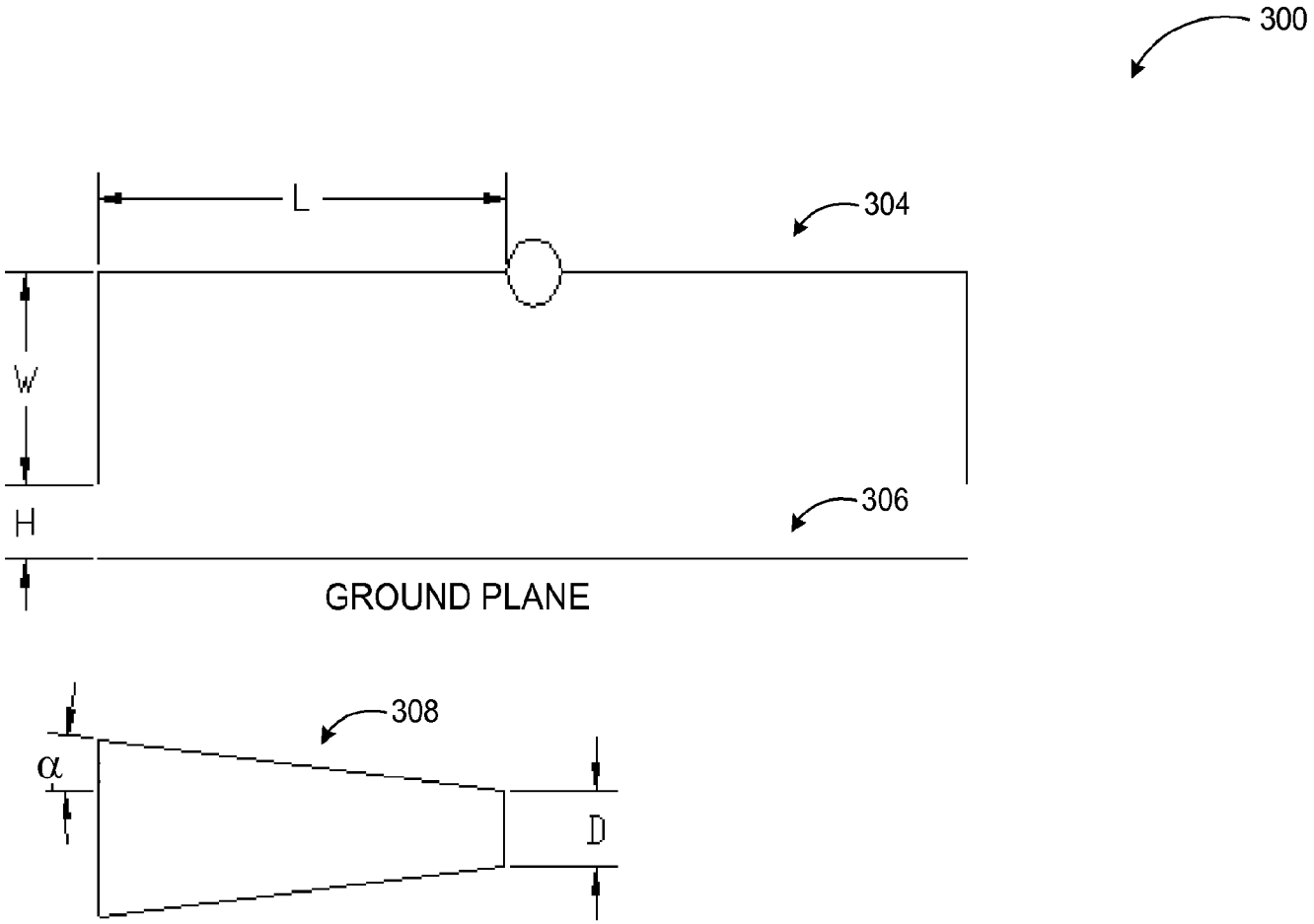
FIG. 3 illustrates design parameters of a bow tie antenna.

FIG. 3 illustrates design parameters of a bow tie antenna, arranged in accordance with at least some embodiments described herein.

As shown in diagram 300, from a cross-sectional view, the bow tie antenna 304 is similar to the bent-dipole antenna of FIG. 1 with a horizontal arm length of L, a vertical arm length of W, and a height from the ground plane 306 of H. Thus, antenna pattern characteristics (e.g., gain, directionality), antenna bandwidth, standing wave ratio, etc. may be adjusted by selecting suitable values for these parameters based on a desired use (center frequency, bandwidth, etc.). Differently from the thin element bent-dipole antennas, each arm 308 (radiating element) of a bow tie antenna has a tapered shape. The tapered shape may be defined by a width of the element D at the base (i.e., where the element is fed) and a taper angle $\alpha$, which defines how wide the element is at the other end.

The ground plane 306 is finite. In some examples, the ground plane's dimensions may be selected as 4L×4L. In a two-element, cross configuration antenna, the two dipoles may be fed by a 90 degree phase shift from the two lumped ports of the hybrid coupler.

Figure 4:
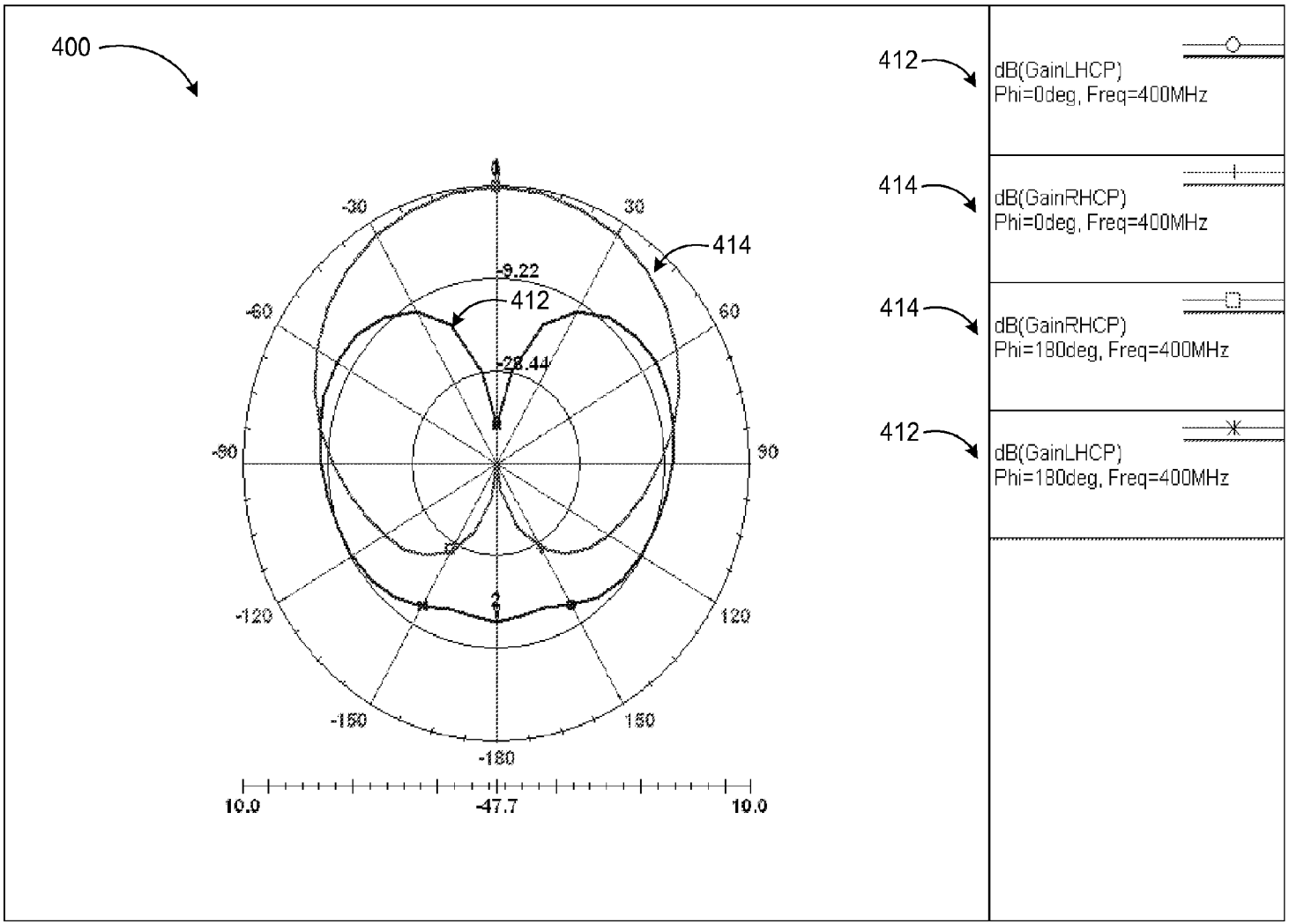
FIG. 4 illustrates radiation patterns of an example bow tie antenna.

FIG. 4 illustrates radiation patterns of an example bow tie antenna, arranged in accordance with at least some embodiments described herein.

Diagram 400 shows simulated antenna patterns for right hand (RHCP) and left hand (LHCP) circular polarizations for a bent-dipole, bow tie antenna according to some examples. For example, the antenna may be RH circularly polarized (414) within 60 degree from the zenith. In a UHF application, a maximum gain of approximately 12 dB may be obtained around 240 MHz, with gain dropping to approximately 9 dB at about 400 MHz. Radiation pattern 412 reflects performance of the same antenna for left hand circular polarization.

The example antenna providing the patterns in diagram 400 may include two bent Moxon type split bowtie elements. The two bent elements may be located perpendicular to each other as shown in FIG. 2 and fed at the center via differential input through a hybrid coupler to produce Right Hand Circular Polarization (RHCP) or Left Hand Circular Polarization (LHCP).

Figure 5:
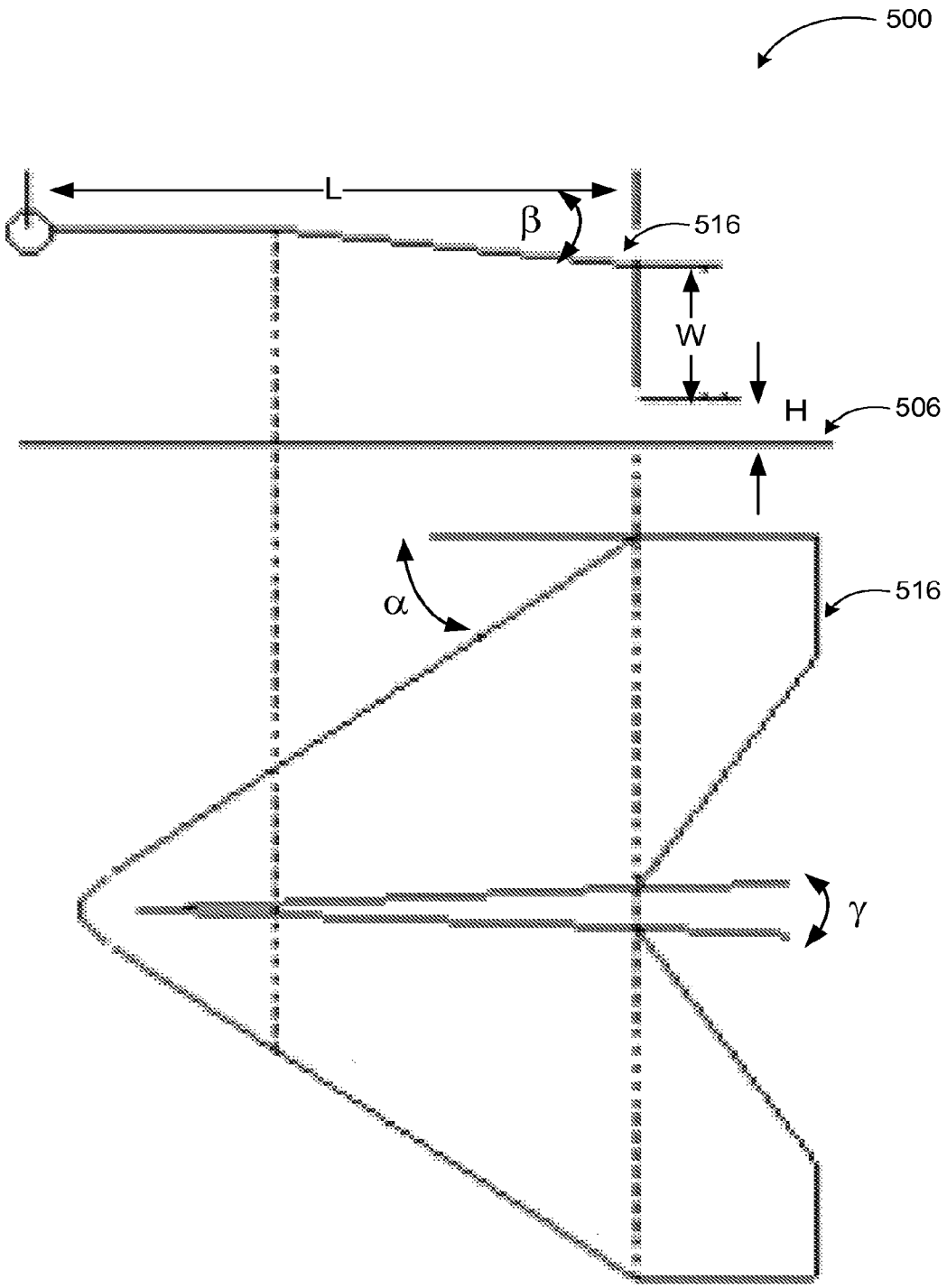
FIG. 5 illustrates major design parameters of a single triangular shaped antenna arm of a split bow tie antenna.

FIG. 5 illustrates major design parameters of a single triangularly tapered shaped antenna arm with a split bow tie antenna, arranged in accordance with at least some embodiments described herein.

As discussed above, in a bent-dipole based antenna according to some example embodiments the arms may be split into two sub-branches to further increase bandwidth and gain of the antenna. Diagram 500 illustrates an example split arm 516 and design parameters of such an antenna that may be adjusted for achieving desired antenna characteristics.

The design parameters may include horizontal arm length L, vertical arm length W, distance between the arm 516 and the ground plane 506 H, taper angle $\alpha$ of the tapered arm, and split angle $\gamma$ of the arm 516. In other example embodiments, a portion of the horizontal arm may be further bent at an angle $\beta$, which may be adjusted to select a desired beam width for the antenna pattern.

Figure 6:
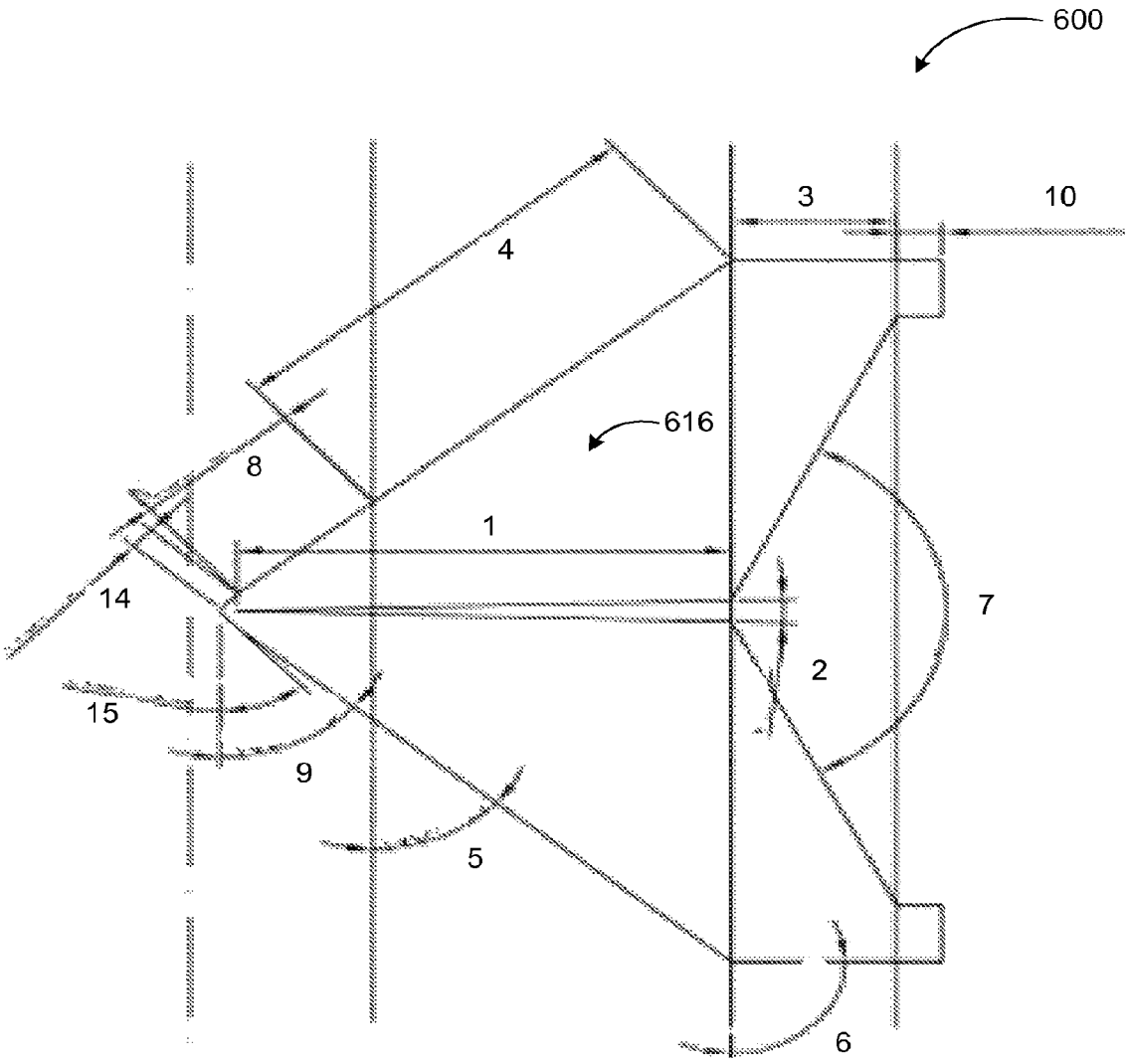
FIG. 6 illustrates some parameters of the single triangular shaped antenna arm of FIG. 5 that may be modified to optimize various antenna characteristics.

FIG. 6 illustrates some parameters of the single triangular shaped antenna arm of FIG. 5 that may be modified to optimize various antenna characteristics, arranged in accordance with at least some embodiments described herein.

The example arm 616 of a split bow tie antenna in diagram 600 includes multiple design parameters that may be selected for desired antenna characteristics. Table 1 below describes some of those design parameters and effects of changing them (e.g., increase or decrease the value) on antenna performance.

TABLE 1

Example design parameters and their effects on antenna performance

| Design param. | Design parameter description | Effects on antenna performance |
|---|---|---|
| 1 | Wedge cutout length | Moving wedge tip closer to the z-axis, effectively makes the first section of the wedge larger, which shifts central. frequency lower and reduces bandwidth |
| 2 | Wedge cutout spread angle | Reducing the angle sharpens the wedge cutout, which increases the bandwidth and shifts central frequency higher. |
| 3 | Vertical length | Increasing the length may result in decreased low resonance point and higher S11 and/or decreased high resonance point and lower S11. The total bandwidth may decrease.<br>Decreasing the length may result in higher low resonance point and lower S11 and/or higher high resonance point and higher S11. The total bandwidth may increase. |
| 4 | Length of the first bend | Increasing the length may result in lower low resonance point and higher S11 and/or lower high resonance point and higher S11 with an increased total bandwidth in RFID frequencies (UHF) and a decreased total bandwidth in GPS frequencies.<br>Decreasing the length may result in higher low resonance point and lower S11 and/or higher high resonance point and lower S11 with a decreased total bandwidth in RFID frequencies (UHF) and an increased total bandwidth in GPS frequencies. |
| 5 | Outer angle of the first bend | Increasing the angle may result in lower low resonance point and higher S11 and/or lower high resonance point and lower S11 with a decreased total bandwidth in RFID frequencies (UHF).<br>Increasing the angle may result in higher low resonance point and lower S11 and/or lower high resonance point and lower S11 with a decreased total bandwidth in GPS frequencies.<br>Decreasing the angle may result in higher low resonance point and lower S11 and/or higher high resonance point and higher S11 with an increased total bandwidth in RFID frequencies (UHF).<br>Decreasing the angle may result in lower low resonance point and higher S11 and/or higher high resonance point and higher S11 with an increased total bandwidth in GPS frequencies. |
| 6 | Outer angle of the vertical section (typically 90 degrees) | Decreasing the outer angle of the vertical section, i.e. sharpening the angle, may improve reflection impedance around lower resonance frequency, while matching around higher resonance frequency may be reduced. Bandwidth loss may not be substantial with sharper outer angle. |
| 7 | Inner angle of the vertical section | Increasing the angle may result in lower low resonance point and lower S11 and/or lower high resonance point and lower S11 with a substantially same total bandwidth in RFID frequencies (UHF).<br>Increasing the angle may result in higher low resonance point and lower S11 and/or lower high resonance point and higher S11 with a decreased total bandwidth in GPS frequencies.<br>Decreasing the angle may result in higher low resonance point and higher S11 and/or higher high resonance point and higher S11 with a substantially same total bandwidth in RFID frequencies (UHF).<br>Decreasing the angle may result in lower low resonance point and higher S11 and/or higher high resonance point and lower S11 with an increased total bandwidth in GPS frequencies. |
| 8 | Horizontal length (no tip) | Increasing the length may result in lower low resonance point and higher S11 and/or lower high resonance point and lower S11 with a decreased total bandwidth.<br>Decreasing the length may result in higher low resonance point and lower S11 and/or higher high resonance point and higher S11 with an increased total bandwidth. |
| 9 | Outer angle of the horizontal section | Increasing the angle may result in higher low resonance point and lower S11 and/or lower high resonance point and higher S11 with a decreased total bandwidth.<br>Decreasing the angle may result in lower low resonance point and higher S11 and/or higher high resonance point and lower S11 with an increased total bandwidth. |

Of course, other design aspects of an antenna according to embodiments may be selected or modified to adjust various antenna performance characteristics to achieve desired performance at selected operating frequency ranges.

Figure 7:
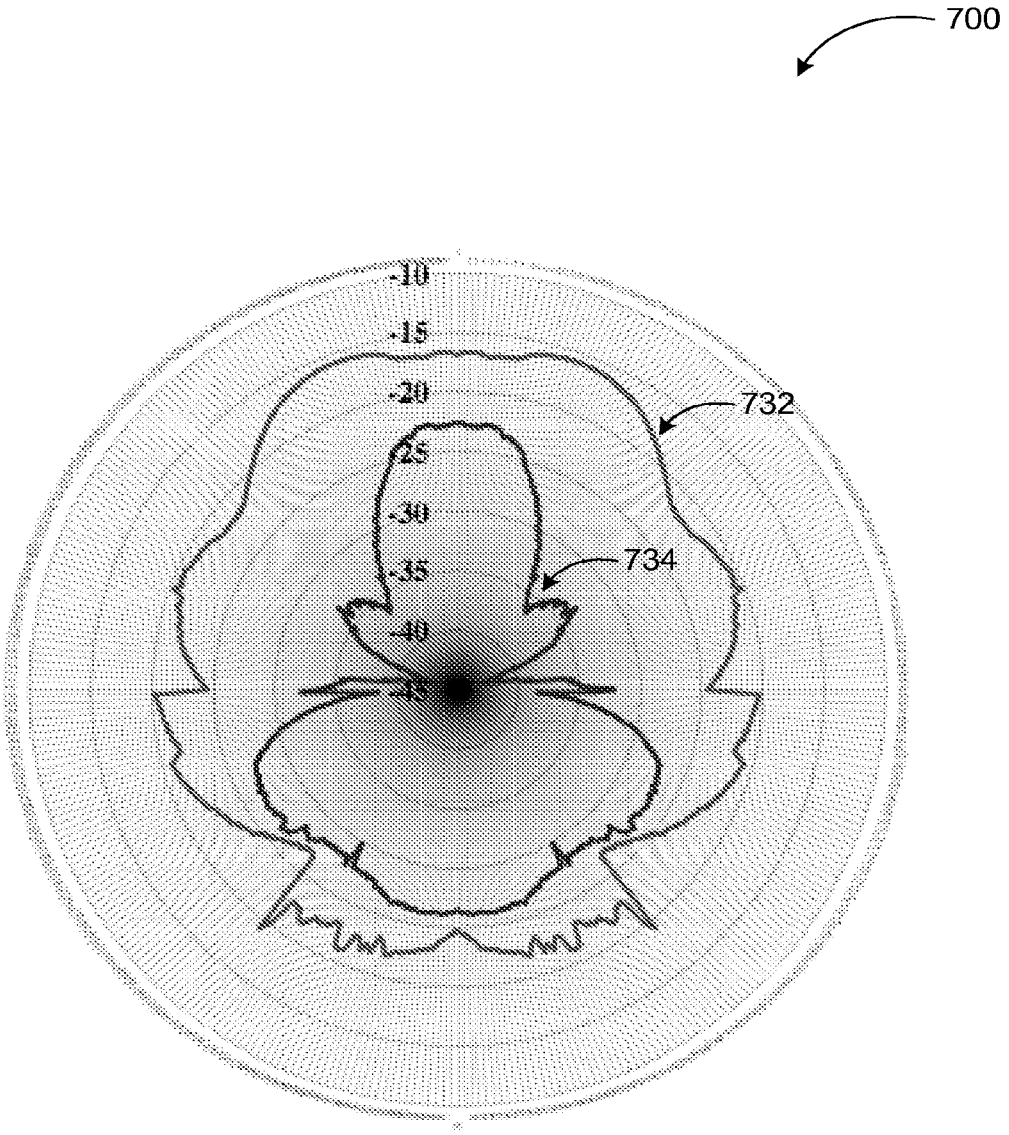
FIG. 7 illustrates radiation pattern of an example broadband, circularly polarized, bent-dipole based antenna in comparison with a standard antenna in RFID band.

FIG. 7 illustrates radiation pattern of an example broadband, circularly polarized, bent-dipole based antenna in comparison with a standard antenna in RFID band, arranged in accordance with at least some embodiments described herein.

Diagram 700 includes two radiation patterns in a polar coordinate system. Radiation pattern 732 corresponds to an example bent-dipole based, Moxon-like antenna with tapered and split arms according to some embodiments. Radiation pattern 734 corresponds to a standard dipole based antenna. Both patterns are in the RFID frequency range (i.e., approx. 900 MHz).

As diagram 700 shows, the radiation pattern of a bent-dipole based, Moxon-like antenna is relatively uniform without substantial nulls. The forward gain of the antenna is about 6 dB higher than the standard antenna, while side gains may be as much as 20 dB higher. Thus, the directionality as well as overall gain of the antenna according to embodiments is enhanced over the standard dipole-based antennas.

In addition to RFID frequencies, a tapered and split arm, bent-dipole, Moxon-like antenna may also be employed in GPS bands (i.e., 1227.60+/−10.23 MHz and 1575.42+/−10.23 MHz). Example dimensions of such an antenna (as shown in FIG. 6) may include:

TABLE 2

Example dimensions of a tapered and split arm, bent-dipole, Moxon-like antenna

| Dimension | Value |
|---|---|
| Wedge cutout spread angle | 3.8 deg |
| Vertical length | 11 mm |
| Length of the first bend | 32 mm |
| Outer angle of the first bend | 8 deg |
| Outer angle of the vertical section | 90 mm |
| Horizontal length (no tip) | 12 mm |
| Outer angle of the horizontal section | 10 deg |

The radiation patterns in diagram 700 and the example antenna providing those patterns are provided for illustrative purposes and do not constitute a limitation on embodiments. Any other form of bent-dipole based antennas with different number of arms, splits, taper and/or bend angles, etc. may be implemented using the principles described herein.

Figure 8:
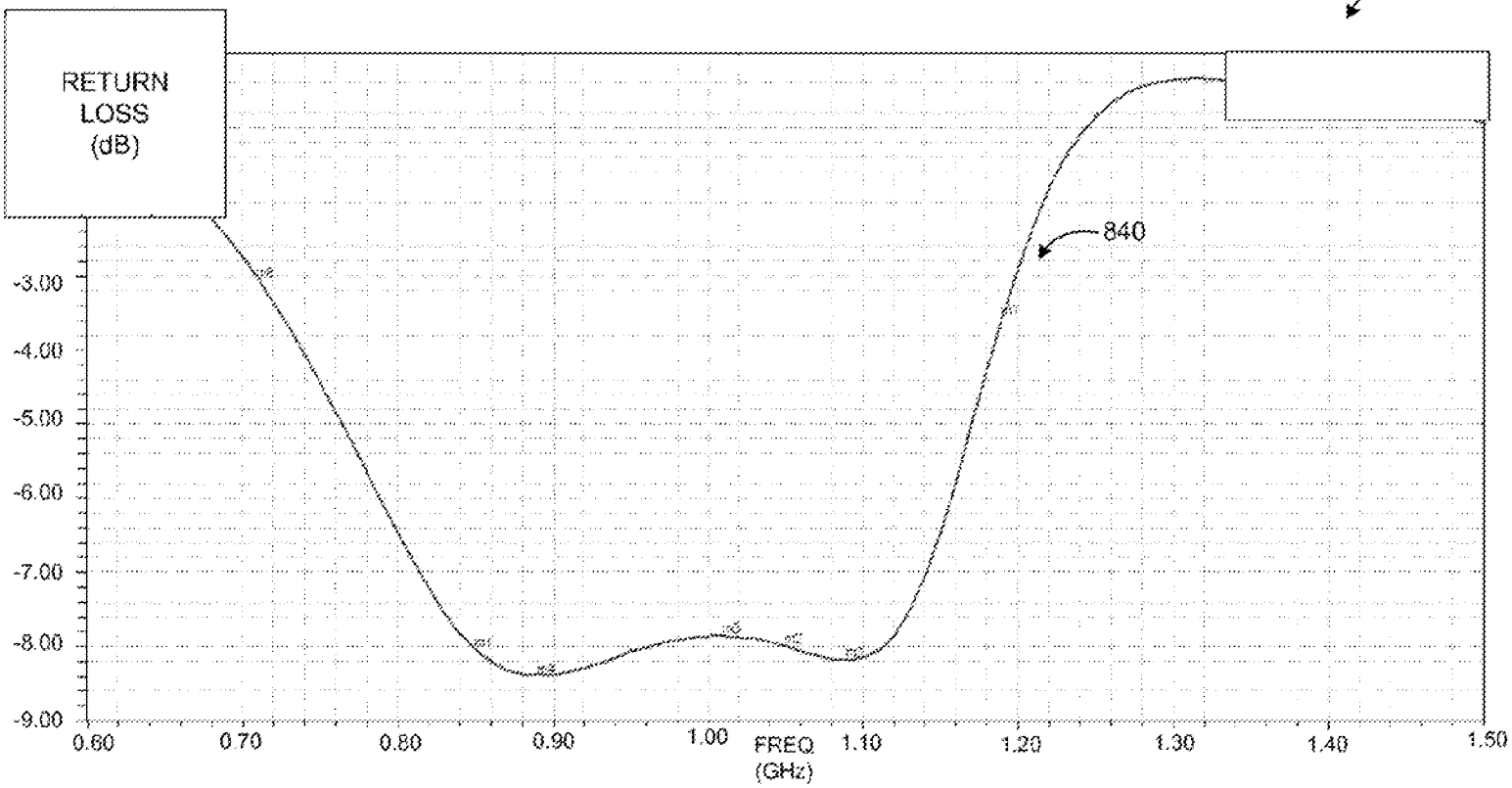
FIG. 8 illustrates simulated return loss for the example antenna of FIG. 7, all arranged in accordance with at least some embodiments described herein.

FIG. 8 illustrates simulated return loss for the example antenna of FIG. 7, arranged in accordance with at least some embodiments described herein.

Diagram 800 shows return loss (S11) of a tapered and split arm, bent-dipole, Moxon-like antenna designed for RFID frequency range. The simulated return loss graph 840 is approximately 3 dB in the frequency range from about 710 MHz to about 1200 MHz. The gain of such an example antenna may be approximately 7 dB with a front-to-rear ratio of −15 dB. In RFID reader applications, an antenna according some embodiments may yield at least a one quarter size by volume as compared to standard RFID antennas with similar parameters.

In case of UHF satellite communication applications, an antenna according to embodiments may yield at least a third size by volume as compared to a standard UHF eggbeater antenna with higher performance in frequency bandwidth, gain, and front-to-back ratios compared to the eggbeater antenna.

Thus, a circularly polarized, bent-dipole, Moxon type antenna according to embodiments with tapered and/or split elements over a ground plane may provide enhanced directionality, gain, return loss, and/or front-to-back ratio, while providing smaller size, especially suitable for mobile applications. Optimized antenna characteristics may be implemented in UHF, RFID, GPS, and satellite communication applications.

According to some examples, a broadband, circularly polarized, bent-dipole based antenna is described. An example antenna may include two or more bent-dipole based radiating elements, where the radiating elements may have a tapered cross-sectional shape, a common input for the radiating elements, and a ground plane at an approximately equal distance from the radiating elements.

In other examples, the common input may include a hybrid 90° quadrature coupler, where the hybrid 90° quadrature coupler may provide right hand circular polarization for the antenna. Each radiating element may be widened in a tapered manner relative to a thin-element bent-dipole, wherein the radiating elements may be in a configuration forming a bow tie structure with approximately 90° bends to achieve broadband operation. The tapered radiating elements may include a split forming two sub-branches on each radiating element, where a bend angle of each radiating element is increased to further increase a bandwidth and a gain of the antenna. The tapered widening of each radiating element may be defined by a width of each radiating element at a coupling location with the common input and a taper angle. A wedge tip of each radiating element may be moved toward a z-axis to shift a central frequency of the antenna lower and to reduce an antenna bandwidth. A wedge cutout spread angle may be reduced to shift a central frequency of the antenna higher and to increase an antenna bandwidth.

In further examples, an increase of a length of a vertical portion of each radiating element may result in an antenna bandwidth decrease; a low resonance point decrease and a return loss increase; and/or a high resonance point decrease and a return loss decrease. A decrease of the length of the vertical portion of each radiating element may result in an antenna bandwidth increase; a low resonance point increase and a return loss decrease; and/or a high resonance point increase and a return loss increase. An increase of a length of a first bend of each radiating element may result in a low resonance point decrease and a return loss increase; and/or a high resonance point decrease and a return loss increase. A decrease of the length of the first bend of each radiating element may result in a low resonance point increase and a return loss decrease; and/or a high resonance point increase and a return loss decrease. The increase of the length of the first bend of each radiating element may result in an increase of an antenna bandwidth in a Radio Frequency Identification (RFID) frequency range and a decrease of the antenna bandwidth in a Global Positioning Service (GPS) frequency range, and the decrease of the length of the first bend of each radiating element may result in a decrease of the antenna bandwidth in the RFID frequency range and an increase of the antenna bandwidth in the GPS frequency range.

In yet further examples, an increase of an outer angle of a first bend of each radiating element may result in an antenna bandwidth decrease; a low resonance point decrease and a return loss increase; and/or a high resonance point decrease and a return loss decrease in an RFID frequency range. The increase of the outer angle of the first bend of each radiating element may result in an antenna bandwidth decrease; a low resonance point increase and a return loss decrease; and/or a high resonance point decrease and a return loss decrease in a GPS frequency range. A decrease of the outer angle of the first bend of each radiating element may result in an antenna bandwidth increase; a low resonance point increase and a return loss decrease; and/or a high resonance point increase and a return loss increase in an RFID frequency range. The decrease of the outer angle of the first bend of each radiating element may result in an antenna bandwidth increase; a low resonance point decrease and a return loss increase; and/or a high resonance point increase and a return loss increase in a GPS frequency range. A decrease of an outer angle of a vertical portion of each radiating element may result in reduced reflection impedance around a lower resonance frequency. An increase of an inner angle of a vertical portion of each radiating element results in at least one from a set of: a low resonance point decrease and a return loss decrease; and/or a high resonance point decrease and a return loss decrease in an RFID frequency range. The increase of the inner angle of the vertical portion of each radiating element may result in an antenna bandwidth decrease; a low resonance point increase and a return loss decrease; and/or a high resonance point decrease and a return loss increase in a GPS frequency range.

In other examples, a decrease of the inner angle of the vertical portion of each radiating element may result in a low resonance point increase and a return loss increase; and/or a high resonance point increase and a return loss increase in an RFID frequency range. The decrease of the inner angle of the vertical portion of each radiating element may result in an antenna bandwidth increase; a low resonance point decrease and a return loss increase; and/or a high resonance point increase and a return loss decrease in a GPS frequency range. An increase of a horizontal length of each radiating element may result in an antenna bandwidth decrease; a low resonance point decrease and a return loss increase; and/or a high resonance point decrease and a return loss decrease. A decrease of the horizontal length of each radiating element may result in an antenna bandwidth increase; a low resonance point increase and a return loss decrease; and/or a high resonance point increase and a return loss increase. An increase of an outer angle of a horizontal portion of each radiating element may result in an antenna bandwidth decrease; a low resonance point increase and a return loss decrease; and/or a high resonance point decrease and a return loss increase. A decrease of the outer angle of the horizontal portion of each radiating element may result in an antenna bandwidth increase; a low resonance point decrease and a return loss increase; and/or a high resonance point increase and a return loss decrease. The antenna may be configured to operate an RFID frequency range, a GPS frequency range, or an ultra-high frequency (UHF) satellite communication frequency range.

According to some embodiments, a method for providing broadband, circularly polarized wireless communication through a bent-dipole based antenna may be provided. An example method may include providing an antenna that includes two or more bent-dipole based radiating elements, where the radiating elements may have a tapered cross-sectional shape, and a ground plane at an approximately equal distance from the radiating elements. The example method may also include providing a signal to a common input for the radiating elements.

In other embodiments, each radiating element may be widened in a tapered manner relative to a thin-element bent-dipole. The radiating elements may be configured to form a bow tie structure with approximately 900 bends to achieve broadband operation. A split may be formed in the tapered radiating elements to create two sub-branches on each radiating element. A bend angle of each radiating element may be increased to further increase a bandwidth and a gain of the antenna. A wedge tip of each radiating element may be moved toward a z-axis to shift a central frequency of the antenna lower and to reduce an antenna bandwidth. A wedge cutout spread angle may be reduced to shift a central frequency of the antenna higher and to increase an antenna bandwidth. A length of a vertical portion of each radiating element may be increased to achieve an antenna bandwidth decrease; a low resonance point decrease and a return loss increase; and/or a high resonance point decrease and a return loss decrease. The length of the vertical portion of each radiating element may be decreased to achieve an antenna bandwidth increase; a low resonance point increase and a return loss decrease; and/or a high resonance point increase and a return loss increase.

In further embodiments, a length of a first bend of each radiating element may be increased to achieve a low resonance point decrease and a return loss increase; and/or a high resonance point decrease and a return loss increase. The length of the first bend of each radiating element may be decreased to achieve a low resonance point increase and a return loss decrease; and/or a high resonance point increase and a return loss decrease. The length of the first bend of each radiating element may be increased to achieve an increase of an antenna bandwidth in a Radio Frequency Identification (RFID) frequency range and a decrease of the antenna bandwidth in a Global Positioning Service (GPS) frequency range; and the length of the first bend of each radiating element may be decreased to achieve a decrease of the antenna bandwidth in the RFID frequency range and an increase of the antenna bandwidth in the GPS frequency range. An outer angle of a first bend of each radiating element may be increased to achieve an antenna bandwidth decrease; a low resonance point decrease and a return loss increase; and/or a high resonance point decrease and a return loss decrease in an RFID frequency range. The outer angle of the first bend of each radiating element may be increased to achieve an antenna bandwidth decrease; a low resonance point increase and a return loss decrease; and/or a high resonance point decrease and a return loss decrease in a GPS frequency range. The outer angle of the first bend of each radiating element may be decreased to achieve an antenna bandwidth increase; a low resonance point increase and a return loss decrease; and/or a high resonance point increase and a return loss increase in an RFID frequency range. The outer angle of the first bend of each radiating element may be decreased to achieve an antenna bandwidth increase; a low resonance point decrease and a return loss increase; and/or a high resonance point increase and a return loss increase in a GPS frequency range.

In yet further embodiments, an outer angle of a vertical portion of each radiating element may be decreased to achieve reduced reflection impedance around a lower resonance frequency. An inner angle of a vertical portion of each radiating element may be increased to achieve a low resonance point decrease and a return loss decrease; and/or a high resonance point decrease and a return loss decrease in an RFID frequency range. The inner angle of the vertical portion of each radiating element to achieve an antenna bandwidth decrease; a low resonance point increase and a return loss decrease; and/or a high resonance point decrease and a return loss increase in a GPS frequency range. The inner angle of the vertical portion of each radiating element may be decreased to achieve a low resonance point increase and a return loss increase; and/or a high resonance point increase and a return loss increase in an RFID frequency range. The inner angle of the vertical portion of each radiating element may be decreased to achieve an antenna bandwidth increase; a low resonance point decrease and a return loss increase; and/or a high resonance point increase and a return loss decrease in a GPS frequency range.

In other embodiments, a horizontal length of each radiating element may be increased to achieve an antenna bandwidth decrease; a low resonance point decrease and a return loss increase; and/or a high resonance point decrease and a return loss decrease. The horizontal length of each radiating element may be decreased to achieve an antenna bandwidth increase; a low resonance point increase and a return loss decrease; and/or a high resonance point increase and a return loss increase. An outer angle of a horizontal portion of each radiating element may be increased to achieve an antenna bandwidth decrease; a low resonance point increase and a return loss decrease; and/or a high resonance point decrease and a return loss increase. The outer angle of the horizontal portion of each radiating element may be increased to achieve an antenna bandwidth increase; a low resonance point decrease and a return loss increase; and/or a high resonance point increase and a return loss decrease.

According to some examples, a broadband, circularly polarized, bent-dipole based antenna may be described. An example antenna may include two bent-dipole based radiating elements, each element having a tapered cross-sectional shape widening from a feed point outward and a split forming two sub-branches, where the radiating elements may be in a substantially perpendicular configuration forming a bow tie structure. The example antenna may also include a common input for the two or more radiating elements, and a ground plane at an approximately equal distance from tips of the radiating elements.

In other examples, the common input may include a hybrid 90° quadrature coupler for providing right hand circular polarization for the antenna. A bend angle of each radiating element may be increased to further increase a bandwidth and a gain of the antenna. The tapered widening of each radiating element may be defined by a width of each radiating element at a coupling location with the common input and a taper angle. A wedge tip of each radiating element may be moved toward a z-axis to shift a central frequency of the antenna lower and to reduce an antenna bandwidth. A wedge cutout spread angle may be reduced to shift a central frequency of the antenna higher and to increase an antenna bandwidth. An increase of a length of a vertical portion of each radiating element may result in an antenna bandwidth decrease; a low resonance point decrease and a return loss increase; and/or a high resonance point decrease and a return loss decrease. A decrease of the length of the vertical portion of each radiating element may result in an antenna bandwidth increase; a low resonance point increase and a return loss decrease; and/or a high resonance point increase and a return loss increase.

In further examples, an increase of a length of a first bend of each radiating element may result in a low resonance point decrease and a return loss increase; and/or a high resonance point decrease and a return loss increase. A decrease of the length of the first bend of each radiating element may result in a low resonance point increase and a return loss decrease; and/or a high resonance point increase and a return loss decrease. The increase of the length of the first bend of each radiating element may result in an increase of an antenna bandwidth in a Radio Frequency Identification (RFID) frequency range and a decrease of the antenna bandwidth in a Global Positioning Service (GPS) frequency range, and the decrease of the length of the first bend of each radiating element may result in in a decrease of the antenna bandwidth in the RFID frequency range and an increase of the antenna bandwidth in the GPS frequency range. An increase of an outer angle of a first bend of each radiating element may result in an antenna bandwidth decrease; a low resonance point decrease and a return loss increase; and/or a high resonance point decrease and a return loss decrease in an RFID frequency range. The increase of the outer angle of the first bend of each radiating element may result in an antenna bandwidth decrease; a low resonance point increase and a return loss decrease; and/or a high resonance point decrease and a return loss decrease in a GPS frequency range. A decrease of the outer angle of the first bend of each radiating element may result in an antenna bandwidth increase; a low resonance point increase and a return loss decrease; and/or a high resonance point increase and a return loss increase in an RFID frequency range. The decrease of the outer angle of the first bend of each radiating element may result in an antenna bandwidth increase; a low resonance point decrease and a return loss increase; and/or a high resonance point increase and a return loss increase in a GPS frequency range.

In yet further examples, a decrease of an outer angle of a vertical portion of each radiating element may result in reduced reflection impedance around a lower resonance frequency. An increase of an inner angle of a vertical portion of each radiating element may result in a low resonance point decrease and a return loss decrease; and/or a high resonance point decrease and a return loss decrease in an RFID frequency range. The increase of the inner angle of the vertical portion of each radiating element may result in an antenna bandwidth decrease; a low resonance point increase and a return loss decrease; and/or a high resonance point decrease and a return loss increase in a GPS frequency range. A decrease of the inner angle of the vertical portion of each radiating element may result in a low resonance point increase and a return loss increase; and/or a high resonance point increase and a return loss increase in an RFID frequency range. The decrease of the inner angle of the vertical portion of each radiating element may result in an antenna bandwidth increase; a low resonance point decrease and a return loss increase; and/or a high resonance point increase and a return loss decrease in a GPS frequency range.

In other examples, an increase of a horizontal length of each radiating element may result in an antenna bandwidth decrease; a low resonance point decrease and a return loss increase; and/or a high resonance point decrease and a return loss decrease. A decrease of the horizontal length of each radiating element may result in an antenna bandwidth increase; a low resonance point increase and a return loss decrease; and/or a high resonance point increase and a return loss increase. An increase of an outer angle of a horizontal portion of each radiating element may result in an antenna bandwidth decrease; a low resonance point increase and a return loss decrease; and/or a high resonance point decrease and a return loss increase. A decrease of the outer angle of the horizontal portion of each radiating element may result in an antenna bandwidth increase; a low resonance point decrease and a return loss increase; and/or a high resonance point increase and a return loss decrease. The antenna may be configured to operate in an RFID frequency range, a GPS frequency range, or an ultra-high frequency (UHF) satellite communication frequency range.

There is little distinction left between hardware and software implementations of aspects of systems; the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, may be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, a solid state drive, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity of gantry systems; control motors for moving and/or adjusting components and/or quantities).

A typical data processing system may be implemented utilizing any suitable commercially available components, such as those typically found in data computing/communication and/or network computing/communication systems. The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A broadband, circularly polarized, bent-dipole based antenna, comprising:

two or more bent-dipole based radiating elements, wherein:

each radiating element includes a tapered cross-sectional shape that widens from a feed point outward, a first bend, a second bend, and a split that forms two sub-branches, wherein the split is formed by a wedge cutout having a length and a spread angle, an outer angle between the first bend and a horizontal plane of the antenna is sized such that the first bend is inclined downward, an outer angle between the second bend and the horizontal plane of the antenna is sized such that the second bend is inclined substantially vertical, wherein vertical portions of the two sub-branches of each radiating element, along the substantially vertical second bend, are shaped so as to form an inner angle between the vertical portions, the length of the wedge cutout extends at least past the first bend towards the feed point, and the spread angle of the wedge cutout is smaller than the inner angle formed between the vertical portions;

a common input terminal for the two or more radiating elements; and a ground plane at an approximately equal distance from the two or more radiating elements.

2. The antenna according, to claim 1, wherein the common input terminal includes a hybrid 90° quadrature coupler.

3. The antenna according to claim 1, wherein the outer angle between the second bend and the horizontal plane of the antenna of each radiating, element is increased to further increase a bandwidth and a gain of the antenna.

4. The antenna according, to claim 1, wherein one or more of:

the tapered cross-sectional shape of each radiating element that widens is defined by a width of each radiating element at a coupling location with the common input terminal and a taper angle;

a tip of the wedge cutout of each radiating element is moved toward a z-axis at the feed Joint to shift a central frequency of the antenna lower and to reduce an antenna bandwidth;

the spread angle of the wedge cutout is reduced to shift a central frequency of the antenna higher and to increase an antenna bandwidth;

an increase of a length of the vertical portions of the two sub-branches of each radiating element results in one or more of an antenna bandwidth decrease; a low resonance point decrease and a return loss increase; and a high resonance point decrease and a return loss decrease; and a decrease of the length of the vertical portions of the two sub-branches of each radiating element results in one or more of: an antenna bandwidth increase, a low resonance point increase and a return loss decrease; and a high resonance point increase and a return loss increase.

5. The antenna according to claim wherein one or more of:

an increase of a length of the first bend of each radiating element results in one or more of a low resonance point decrease and a return loss increase; and a high resonance point decrease and a return loss increase;

a decrease of the length of the first bend of each radiating element results in one or more of a low resonance point increase and a return loss decrease; and a high resonance point increase and a return loss decrease;

the increase of the length of the first bend of each radiating element results in an increase of an antenna bandwidth in a radio frequency identification (RF ID) frequency range and a decrease of the antenna bandwidth in a global positioning, system (GPS) frequency range; and the decrease of the length of the first bend of each radiating element results in a decrease of the antenna bandwidth in the RFID frequency range and an increase of the antenna bandwidth in the GPS frequency range.

6. The antenna according to claim 1, wherein one or more of:

an increase of the outer angle between the first bend and the horizontal plane of the antenna of each radiating element results in one or more of: an antenna bandwidth decrease; a low resonance point decrease and a return loss increase; and a high resonance point decrease and a return loss decrease in a REID frequency range;

the increase of the outer angle between the first bend and the horizontal plane of the antenna of each radiating element results in one or more of: an antenna bandwidth decrease; a low resonance point increase and a return loss decrease; and a high resonance point decrease and a return loss decrease in a GPS frequency range;

a decrease of the outer angle between the first bend and the horizontal plane of the antenna of each radiating element results in one or more of: an antenna bandwidth increase; a low resonance point increase and a return loss decrease; and a high resonance point increase and a return loss increase in the RFID frequency range; and the decrease of the outer angle between the first bend and the horizontal plane of the antenna of each radiating element results in one or more of: an antenna bandwidth increase; a low resonance point decrease and a return loss increase; and a high resonance point increase and a return loss increase in the GPS frequency range.

7. The antenna according to claim 1, wherein a decrease of the outer angle between the second bend and the horizontal plane of the antenna of each radiating element results in reduced reflection impedance around a lower resonance frequency.

8. A method to support broadband, circularly polarized wireless communication through a bent-dipole based antenna, the method comprising:

operating an antenna that includes:

two or more bent-dipole based radiating elements, wherein:

each radiating element includes a tapered cross-sectional shape that widens from a feed point outward, a first bend, a second bend, and a split that forms two sub-branches, wherein the split is formed by a wedge cutout having a length and a spread angle, an outer angle between the first bend and a horizontal plane of the antenna is a sharp angle, an outer angle between the second bend and the horizontal plane of the antenna is substantially a right angle, wherein portions of the two sub-branches of each radiating element, along the second bend, are shaped so as to form an inner angle between the portions, the length of the wedge cutout extends at least past the first bend towards the feed point, and the spread angle of the wedge cutout is smaller than the inner angle funned between the portions; and a ground plane at an approximately equal distance from the radiating elements; and receiving a signal at a common input terminal for the two or more radiating elements.

9. The method according to claim 8, further comprising one or more of:

decreasing the outer angle between the second bend and the horizontal plane of the antenna of each radiating element to achieve one or more of: a low resonance point decrease and a return loss decrease; and a high resonance point decrease and a return loss decrease in a radio frequency identification (RFID) frequency range;

decreasing the outer angle between the second bend and the horizontal plane of the antenna of each radiating element to achieve one or more of: an antenna bandwidth decrease; a low resonance point increase and a return loss decrease; and a high resonance point decrease and a return loss increase in a global positioning system (GPS) frequency range;

increasing the outer angle between the second bend and the horizontal plane of the antenna of each radiating element to achieve one or more of: a low resonance point increase and a return loss increase; and a high resonance point increase and a return loss increase in the RFID frequency range; and increasing the outer angle between the second bend and the horizontal plane of the antenna of each radiating element to achieve one or more of an antenna bandwidth increase; a low resonance point decrease and a return loss increase; and a high resonance point increase and a return loss decrease in the GPS frequency range.

10. The method according to claim 8, further comprising one or more of:

increasing the outer angle between the first bend and the horizontal plane of the antenna of each radiating, element to achieve one or more of: an antenna bandwidth decrease; a low resonance point increase and a return loss decrease; and a high resonance point decrease and a return loss increase; and decreasing the outer angle between the first bend and the horizontal plane of the antenna of each radiating element to achieve one or more of: an antenna bandwidth increase; a low resonance point decrease and a return loss increase; and a high resonance point increase and a return loss decrease.

11. A broadband, circularly polarized, bent-dipole based antenna, comprising:

two bent-dipole based radiating elements, wherein:

each radiating element includes a tapered cross-sectional shape that widens from a feed point outward, a first bend, a second bend, and a split that forms two sub-branches, wherein the split is formed by a wedge cutout having a length and a spread angle, an outer angle between the first bend and a horizontal plane of the antenna is a sharp angle, an outer angle between the second bend and the horizontal plane of the antenna is substantially a right angle, wherein portions of the two sub-branches of each radiating element, alone the second bend, are shaped so as to form an inner angle between the portions, the length of the wedge cutout extends at least past the first bend towards the feed point, the spread angle of the wedge cutout is smaller than the inner angle formed between the portions, and the two or more radiating elements are in a substantially perpendicular configuration to each other so as to form a bow tie structure;

a common input terminal for the two or more radiating elements; and a ground plane at an approximately equal distance from tips of the two or more radiating elements.

12. The antenna according to claim 11, wherein one or more of:

the tapered cross-sectional shape that widens each radiating element is defined by a width of each radiating element at a coupling location with the terminal input terminal and a taper angle;

a tip of the wedge cutout of each radiating element is moved toward a z-axis at the feed point to shift a central frequency of the antenna lower and to reduce an antenna bandwidth; and the spread angle of the wedge cutout is reduced to shift a central frequency of the antenna higher and to increase an antenna bandwidth.

13. The antenna according to claim 11, wherein one or more of:

an increase of a length of a vertical portion of each radiating element results in one or more of an antenna bandwidth decrease; a low resonance point decrease and a return loss increase; and a high resonance point decrease and a return loss decrease;

a decrease of the length of the vertical portion of each radiating element results in one or more of: an antenna bandwidth increase; a low resonance point increase and a return loss decrease; and a high resonance point increase and a return loss increase;

an increase of a length of the first bend of each radiating element results in one or more of: a low resonance point decrease and a return loss increase; and a high resonance point decrease and a return loss increase;

a decrease of the length of the first bend of each radiating element results in one or more of: a low resonance point increase and a return loss decrease; and a high resonance point increase and a return loss decrease.

14. The antenna according to claim 11, wherein one or more of:

an increase of the outer angle between the first bend and the horizontal plane of the antenna of each radiating element results in one or more of an antenna bandwidth decrease; a low resonance point decrease and a return loss increase; and a high resonance point decrease and a return loss decrease in a radio frequency identification (RFID) frequency range;

the increase of the outer angle between the first, bend and the horizontal plane of the antenna of each radiating element results in one or more of: an antenna bandwidth decrease; a low resonance point increase and a return loss decrease; and a high resonance point decrease and a return loss decrease in a global positioning system (GPS) frequency range;

a decrease of the outer angle between the first bend and the horizontal plane of the antenna of each radiating element results in one or more of: an antenna bandwidth increase; a low resonance point increase and a return loss decrease; and a high resonance point increase and a return loss increase in the RFID frequency range; and the decrease of the outer angle between the first bend and the horizontal plane of the antenna of each radiating element results in one or more of: an antenna bandwidth increase; a low resonance point decrease and a return loss increase; and a high resonance point increase and a return loss increase in the GM frequency range.

15. The antenna according to claim 11, wherein a decrease of the outer angle between the second bend and the horizontal plane of the antenna of each radiating element results in reduced reflection impedance around a lower resonance frequency.

16. The antenna according to claim 11, wherein one or more of:

a decrease of the outer angle between the second bend and the horizontal plane of the antenna of each radiating element results in one or more of: a low resonance point decrease and a return loss decrease; and a high resonance point decrease and a return loss decrease in a radio frequency identification (RFID) frequency range;

the decrease of the outer angle between the second bend and the horizontal plane of the antenna of each radiating element results in one or more of: an antenna bandwidth decrease; a low resonance point increase and a return loss decrease; and a high resonance point decrease and a return loss increase in a global positioning system (GPS) frequency range;

an increase of the outer angle between the second bend and the horizontal plane of the antenna of each radiating element results in one or more of: a low resonance point increase and a return loss increase; and a high resonance point increase and a return loss increase in the RFID frequency range; and the increase of the outer angle between the second bend and the horizontal plane of the antenna of each radiating element results in one or more of: an antenna bandwidth increase; a low resonance point decrease and a return loss increase; and a high resonance point increase and a return loss decrease in the GPS frequency range.

17. The antenna according to claim 11, wherein one or more of:

an increase of a horizontal length of each radiating element results in one or more of: an antenna bandwidth decrease; a low resonance point decrease and a return loss increase; and a high resonance point decrease and a return loss decrease; and a decrease of the horizontal length of each radiating element results in one or more of: an antenna bandwidth increase; a low resonance point increase and a return loss decrease; and a high resonance point increase and a return loss increase.

18. The antenna according, to claim 11, wherein one or more of:

an increase of the outer angle between the first bend and the horizontal plane of the antenna of each radiating element results in one or more of: an antenna bandwidth decrease; a low resonance point increase and a return loss decrease; and a high resonance point decrease and a return loss increase; and a decrease of the outer angle between the first bend and the horizontal plane of the antenna of each radiating element results in one or more of: an antenna bandwidth increase; a low resonance point decrease and a return loss increase; and a high resonance point increase and a return loss decrease.

19. The antenna according to claim 11, wherein the antenna is configured to operate in one of a radio frequency identification (RFID) frequency range, a global positioning system (GPS) frequency range: or an ultra-high frequency (UHF) satellite communication frequency range.

20. A broadband, circularly polarized, bent-dipole based antenna, comprising:

two bent-dipole based radiating elements, wherein:

each radiating element includes a tapered cross-sectional shape that widens from a feed point outward, a first bend, a second bend, and a split that forms two sub-branches, wherein the split is formed by a wedge cutout having a length and a spread angle, an outer angle between the second bend and a horizontal plane of the antenna is substantially a right angle, wherein portions of the two sub-branches of each radiating element, alone the second bend, are shaped so as to form an inner angle between the portions, an outer angle between the first bend and the horizontal plane of the antenna is smaller in magnitude than the outer angle between the second bend and the horizontal plane of the antenna, the length of the wedge cutout extends at least past the first bend towards the feed point, the spread angle of the wedge cutout is smaller than the inner angle formed between the portions, and the two or more radiating elements are in a substantially perpendicular configuration to each other so as to form a bow tie structure;

a common input terminal for the two or more radiating elements; and a ground plane at an approximately equal distance from tips of the two or more radiating elements.

* * * * *

UNITED STATES PATENT AND TRADEMARK OFFICE

CERTIFICATE OF CORRECTION

PATENT NO. : 9,190,734 B2
APPLICATION NO. : 13/814918
DATED : November 17, 2015
INVENTOR(S) : Niver et al.

It is certified that error appears in the above-identified patent and that said Letters Patent is hereby corrected as shown below:

In The Specification

In Column 1, Line 8, delete "§371" and insert -- § 371 --, therefor.

In Column 1, Line 10, delete "§119 (e)" and insert -- § 119 (e) --, therefor.

In The Claims

In Column 16, Line 13, in Claim 3, delete "radiating, element" and insert -- radiating element --, therefor.

In Column 16, Line 22, in Claim 4, delete "Joint" and insert -- point --, therefor.

In Column 16, Line 30, in Claim 4, delete "more of" and insert -- more of: --, therefor.

In Column 16, Line 35, in Claim 4, delete "increase," and insert -- increase; --, therefor.

In Column 16, Line 38, in Claim 5, delete "claim wherein" and insert -- claim 1, wherein --, therefor.

In Column 16, Line 40, in Claim 5, delete "more of" and insert -- more of: --, therefor.

In Column 16, Line 44, in Claim 5, delete "more of" and insert -- more of: --, therefor.

In Column 16, Line 49, in Claim 5, delete "(RF ID)" and insert -- (RFID) --, therefor.

In Column 16, Line 51, in Claim 5, delete "positioning," and insert -- positioning --, therefor.

In Column 17, Line 42, in Claim 8, delete "funned" and insert -- formed --, therefor.

Signed and Sealed this
Eighth Day of March, 2016

Michelle K. Lee

Michelle K. Lee
*Director of the United States Patent and Trademark Office*

In Column 18, Line 3, in Claim 9, delete “one or more of” and insert -- one or more of: --, therefor.

In Column 18, Line 10, in Claim 10, delete “each radiating,” and insert -- each radiating --, therefor.

In Column 18, Line 34, in Claim 11, delete “alone” and insert -- along --, therefor.

In Column 18, Line 64, in Claim 13, delete “one or more of” and insert -- one or more of: --, therefor.

In Column 19, Line 18, in Claim 14, delete “one or more of” and insert -- one or more of: --, therefor.

In Column 19, Line 23, in Claim 14, delete “first, bend” and insert -- first bend --, therefor.

In Column 19, Line 41, in Claim 14, delete “GM” and insert -- GPS --, therefor.

In Column 20, Line 37, in Claim 19, delete “range:” and insert -- range, --, therefor.

In Column 20, Line 50, in Claim 20, delete “alone” and insert -- along --, therefor.